US007140349B2

(12) United States Patent
Hanasato

(10) Patent No.: US 7,140,349 B2
(45) Date of Patent: Nov. 28, 2006

(54) MULTIPLE THROTTLE DEVICE

(75) Inventor: Maki Hanasato, Odawara (JP)

(73) Assignee: Mikuni Corporation, Tokyo (JP)

( * ) Notice: Subject to any disclaimer, the term of this patent is extended or adjusted under 35 U.S.C. 154(b) by 9 days.

(21) Appl. No.: 10/530,280

(22) PCT Filed: Oct. 10, 2003

(86) PCT No.: PCT/JP03/13032

§ 371 (c)(1),
(2), (4) Date: Apr. 5, 2005

(87) PCT Pub. No.: WO2004/033875

PCT Pub. Date: Apr. 22, 2004

(65) Prior Publication Data

US 2006/0042589 A1 Mar. 2, 2006

(30) Foreign Application Priority Data

Oct. 11, 2002 (JP) ..... 2002-298524

(51) Int. Cl.
*F02D 9/10* (2006.01)
*F02D 11/10* (2006.01)

(52) U.S. Cl. ..... 123/336; 123/399

(58) Field of Classification Search ..... 123/336, 123/337, 361, 399; 251/308
See application file for complete search history.

(56) References Cited

U.S. PATENT DOCUMENTS 5,651,343 A * 7/1997 Evans et al. ..... 123/336
2002/0056824 A1 5/2002 Rentschler et al. ..... 251/308

FOREIGN PATENT DOCUMENTS

| | | | |
|---|---|---|---|
| JP | 5-40285 | | 10/1993 |
| JP | 6-207535 | | 7/1994 |
| JP | 8-218904 | | 8/1996 |
| JP | 8-218945 | | 8/1996 |
| JP | 2002-242680 | | 8/2002 |
| JP | 2002-256895 | * | 9/2002 |
| JP | 2002-256896 | | 9/2002 |

* cited by examiner

*Primary Examiner*—T. M. Argenbright

(57) ABSTRACT

According to the present apparatus, on multi-throttle apparatus provided with multiple throttle valves 20 that are respectively disposed in multiple intake passages 11, a throttle shaft 30 that simultaneously opens/closes the throttle valves 20, drive means 50 that drives the throttle shaft 30, and a return spring 60, the driving force of the drive means 50 is applied to an approximate center of the throttle shaft 30, the energizing force of the return spring 60 is applied close to the location to which the energizing force is applied, and bearings 40 are provided in mutual intervals between the multiple intake passages 11 to support the throttle shaft 30. Consequently, torsion of the throttle shaft 30 is prevented, and the throttle valves 20 are opened/closed synchronously without generating a phase shift. Consequently, electronic control is provided for multi-throttle apparatuses applied to engines of two-wheeled vehicles and the like, and the synchronization among throttle valves is secured.

14 Claims, 7 Drawing Sheets

MULTIPLE THROTTLE DEVICE

TECHNICAL FIELD

The present invention relates to a multi-throttle apparatus which synchronously opens/closes a large number of throttle valves disposed in intake passages of an engine, and more particularly relates to a multi-throttle apparatus including throttle valves respectively disposed in intake passages for respective cylinders of an engine installed on two-wheeled vehicle and the like.

BACKGROUND ART

A throttle apparatus of dual cable/electronic control type, and a throttle apparatus of single electronic control type have been known as conventional throttle apparatuses applied to engines installed on four-wheeled vehicles.

For example, on an intake system provided with two surge tanks which are used to combine each three intake passages corresponding to respective cylinders on a V-type six-cylinder engine, and intake passages extending upstream from the respective surge tanks, the conventional dual cable/electronic-controlled throttle apparatus interlocks two throttle valves with each other, which are disposed in the respective upstream intake passages, by means of a single throttle shaft, thereby driving the throttle valves to be opened/closed by means of a cable or a motor (refer to patent document 1, for example).

The conventional electronic-controlled throttle apparatus rotatably combines throttle valves, which are disposed respectively in two intake passages formed on throttle body, by means of a single throttle shaft, thereby driving the throttle valves to be opened/closed by means of a motor disposed on one end of the throttle shaft (refer to patent document 2, for example).

The above-mentioned conventional apparatuses are disposed upstream of the surge tanks or upstream of the relatively long intake passages, and the intake air controlled by the opening/closing action of the throttle valves is thus once accumulated in the surge tanks, and is then flowed through the intake passages corresponding to the respective cylinders. Thus, a change in the intake air quantity due to a small variation of the opening/closing operations of the throttle valves, a displacement from the synchronization of the two throttle valves, and the like do not pose serious problems.

On the other hand, as throttle apparatuses for engines installed on two-wheeled vehicles and the like, due to the responsiveness to a throttle operation being emphasized, there has been known a multi-throttle apparatus where throttle valves are disposed respectively in intake passages corresponding to the respective cylinders (intake ports) at a location close to the intake port of a cylinder head, throttle shafts rotatably supporting the respective throttle valves are connected by a synchronization lever, an energizing spring, and the like used for a transmission of the torque, and a single cable is used to drive all the throttle valves to be opened/closed. In addition, on this apparatus, an independent ISC valve is provided to carry out idle speed control (ISC) of the engine.

[Patent Document 1]

Japanese Laid-Open Patent Publication (Kokai) No. H6-207535

[Patent Document 2]

Japanese Laid-Open Patent Publication (Kokai) No. H8-218904

It has been studied to provide electronic control which drives multiple throttle valves by means of a motor, and further, control of the idle speed by finely adjusting the opening/closing angle of the throttle valves without an independent ISC valve also on engines installed on two-wheeled vehicles and the like. In addition, the throttle operation on the two-wheeled vehicles is more sensitive than that on four-wheeled vehicles, and is accompanied by rapid changes, and there are thus required a precision in the synchronization corresponding to the sensitivity, high responsiveness following the rapid changes, and the like.

If the above-mentioned conventional throttle apparatuses for four-wheeled vehicles are applied as a throttle apparatus for two-wheeled vehicle and the like, the responsiveness is inferior, and the practicality lacks. Namely, on these apparatuses, a middle portion of the throttle shaft is directly supported by through holes on the throttle bodies or brackets, the friction resistance is thus large on sliding parts, and due to influence of a resistive force of the intake air received by the throttle valves caused by the rapid change, the moment of inertia of the throttle valves, and the like, the throttle shaft may be brought in close contact with the through holes to generate a stick and the like, or the throttle shaft may generate a torsion to cause mutual displacements from the synchronization among the throttle valves and the like.

In addition, if a motor is simply installed on the conventional multi-throttle apparatus for two-wheeled vehicles, and electronic control is intended while the rotation angle of the throttle shaft is used as a control parameter, mutual slight displacements from the synchronization (phase shift) among the throttle valves and the like, which are permitted in the conventional cable control, cause obstruction in the realization of the electronic control. Especially, it is necessary to surely prevent the displacement from the synchronization for the control in the case of carrying out the idle speed control by means of the throttle valves without the ISC valve.

The present invention is devised in view of the problems of the above-mentioned prior art, and has an object of providing a multi-throttle apparatus which, upon driving multiple throttle valves respectively disposed in intake passages to be opened/closed by the motor, is excellent in responsiveness to rapid changes while synchronizing the respective throttle valves, integrates components, reduces the size, and is preferable for high-performance engines installed especially on two-wheeled vehicles and the like.

DISCLOSURE OF THE INVENTION

A multi-throttle apparatus according to the present invention including a throttle body that defines multiple intake passages corresponding to respective engine cylinders, multiple throttle valves that are disposed respectively in the multiple intake passages, a throttle shaft that supports the multiple throttle valves to be simultaneously opened/closed, drive means that includes a motor that rotatably drives the throttle shaft, and a return spring that returns the throttle valves to a predetermined angular position, employs such a configuration that the drive means is disposed to apply a driving force to the throttle shaft at a location in a mutual interval close to the center, the mutual interval being one of mutual intervals between the throttle valves disposed at multiple locations, the return spring is disposed close to a location to which the driving force of the drive means is applied, and the throttle body includes bearings that support the throttle shaft in the multiple mutual intervals between the intake passages.

With this configuration, if the motor drives the throttle shaft, the respective throttle valves disposed in the multiple intake passages turn to carry out the open operation against the energizing force of the return spring, and, on the other hand, if the motor stops, the energizing force of the return spring causes a reverse rotation to carry out the close operation.

On this occasion, since the throttle shaft is supported by the bearings in the mutual intervals between the intake passages, the driving force of the motor is applied to the throttle shaft at the location in the mutual interval close to the center, the mutual interval being one of the multiple mutual intervals between the throttle valves disposed at the multiple locations, and the energizing force of the return spring is applied close to the driving force, the torsion of the throttle shaft is prevented, and the respective throttle valves are synchronized without generating a phase shift, follow rapid changes, and operate smoothly.

The above-mentioned configuration may employ such a configuration that the throttle shaft includes two throttle shafts separated by the area as a border to which the driving force of the drive means is applied, and the two throttle shafts are connected so as to rotate coaxially and integrally.

With this configuration, since the throttle shaft is separated into the two parts by the area as a border to which the driving force of the drive means is applied, and both of them are connected rigidly, it is possible to facilitate the disposition of the drive means while the synchronization of both of them is secured.

A multi-throttle apparatus according to the present invention including a throttle body that defines multiple intake passages corresponding to respective engine cylinders, multiple throttle valves that are disposed respectively in the multiple intake passages, a throttle shaft that supports the multiple throttle valves to be simultaneously opened/closed, drive means that includes a motor that rotatably drives the throttle shaft, and a return spring that returns the throttle valves to a predetermined angular position, employs such a configuration that the drive means is disposed to apply a driving force to the throttle shaft at a location on one end of the throttle valves disposed at multiple locations, the return spring is disposed close to a location to which the driving force of the drive means is applied, and the throttle body includes bearings that support the throttle shaft in the mutual intervals between the intake passages.

With this configuration, if the motor drives the throttle shaft, the respective throttle valves disposed in the multiple intake passages turn to carry out the open operation against the energizing force of the return spring, and, on the other hand, if the motor stops, the energizing force of the return spring causes a reverse rotation to carry out the close operation.

On this occasion, since the throttle shaft is supported by the bearings in the mutual intervals between the intake passages, and the energizing force of the return spring is applied close to the driving force, the torsion of the throttle shaft is prevented, and the respective throttle valves are synchronized without generating a phase shift, follow rapid changes, and operate smoothly.

The both above-mentioned configurations of the present invention may employ such a configuration that the return spring includes multiple return springs that are disposed along the throttle shaft, and apply energizing forces different from each other, and a return spring of the multiple return springs that applies the largest energizing force is disposed close to the location to which the driving force of the drive means is applied.

With this configuration, since the multiple energizing forces are applied along the throttle shaft, the return operation of the throttle shaft is carried out smoothly, and, especially, since the largest energizing force is applied close to the location to which the driving force of the drive means is applied, it is possible to prevent the torsion of the throttle shaft, and the synchronization of the throttle valves is secured.

The both above-mentioned configurations of the present invention may employ such a configuration that the throttle body includes multiple throttle bodies that define the multiple intake passages respectively, and are connected to each other in the direction in which the throttle shaft extends, and the multiple throttle bodies include engagement sections that engage the bearing.

With this configuration, it is possible to readily dispose the bearings in the mutual intervals between the intake passages by connecting the respective throttle bodies after the bearings are engaged with the engagement sections.

The both above-mentioned configurations of the present invention may employ such a configuration that the multiple throttle bodies are connected with each other via a spacer that adjusts the mutually separated distance.

With this configuration, even if the mutual distances between the engine cylinders (intake ports) are different from each other, the multi-throttle apparatus can be readily configured corresponding to various engines by properly adjusting the length of the spacers.

The above-mentioned configuration may employ such a configuration that the spacers are formed so as to fix the bearings to the throttle bodies.

With this configuration, it is not necessary to employ a dedicated component used to fix the bearings, thereby simplifying the structure.

The both above-mentioned configurations of the present invention may employ such a configuration that the multiple throttle valves are formed such that the cross section thereof tapers off to the tip thereof as departed from the rotation center.

With this configuration, the moments of inertia of the throttle valves decrease, and the responsiveness to rapid changes increases, and the torsion of the throttle shaft is prevented more surely.

BEST MODE FOR CARRYING OUT THE INVENTION

A description will now be given of embodiments of the present invention with reference to accompanying drawings.

Figure 1:
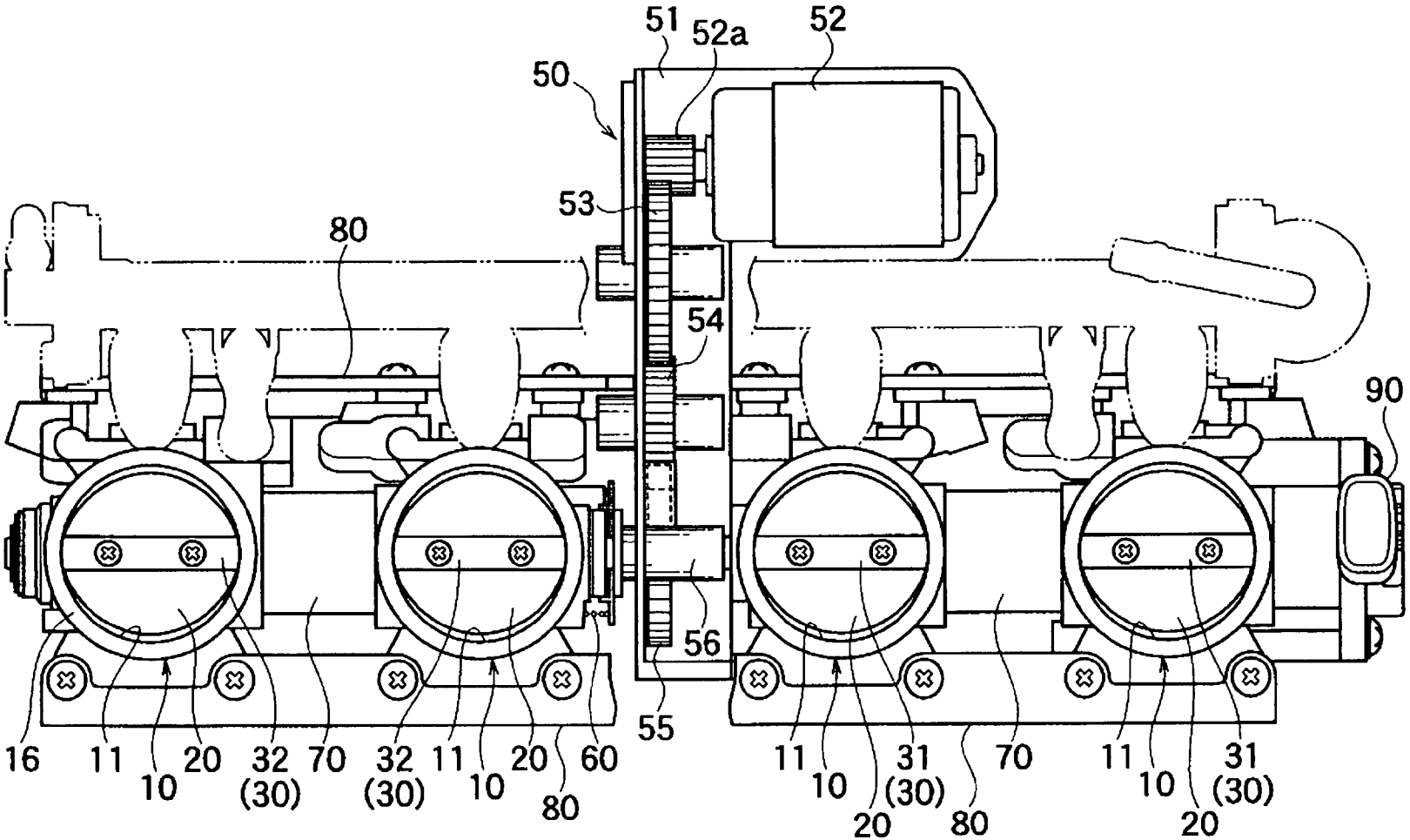
FIG. 1 is a configuration schematic showing an embodiment of a multi-throttle apparatus according to the present invention.
Figure 2:
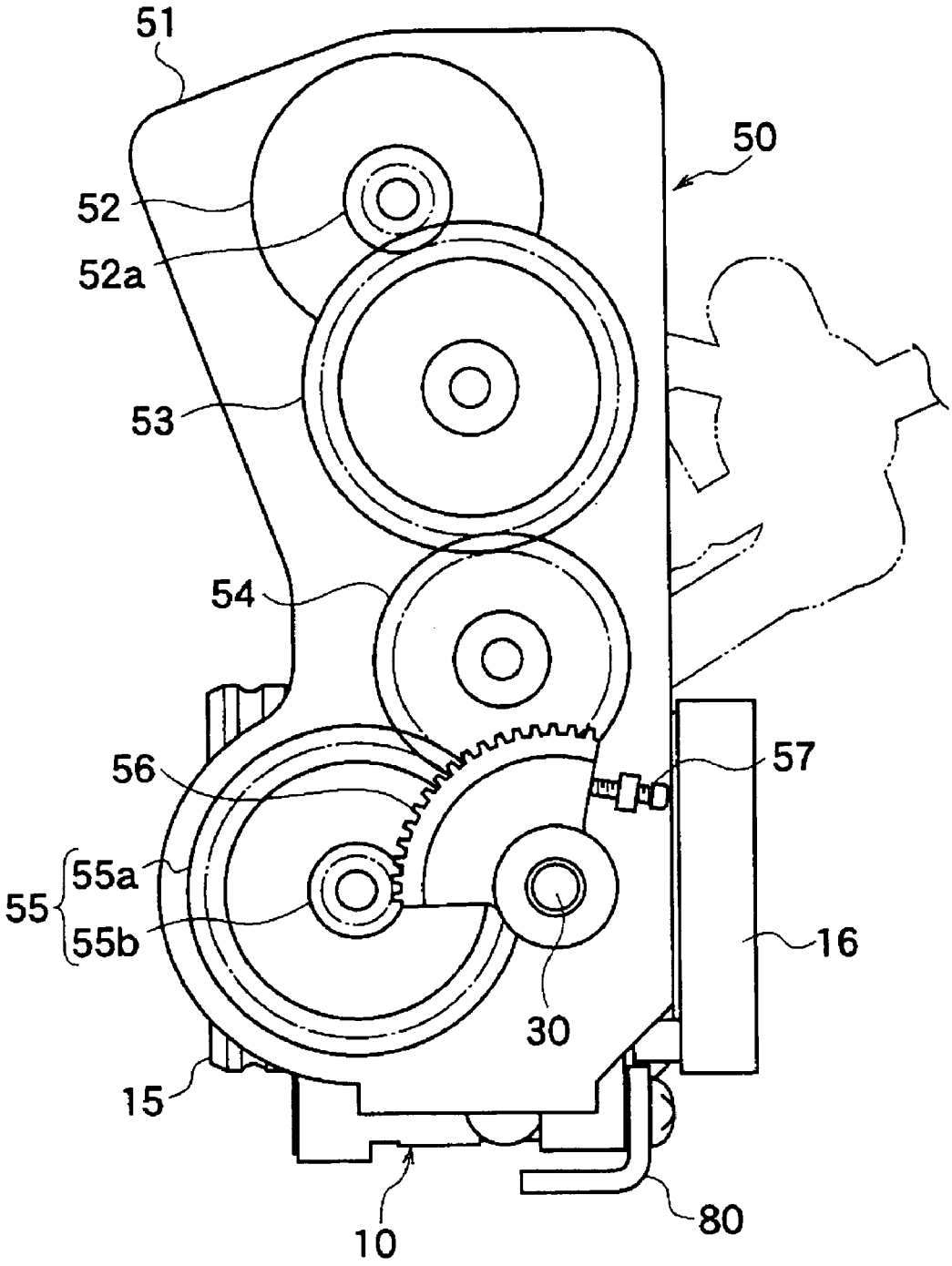
FIG. 2 is a side view showing drive means of the apparatus shown in FIG. 1.
Figure 3:
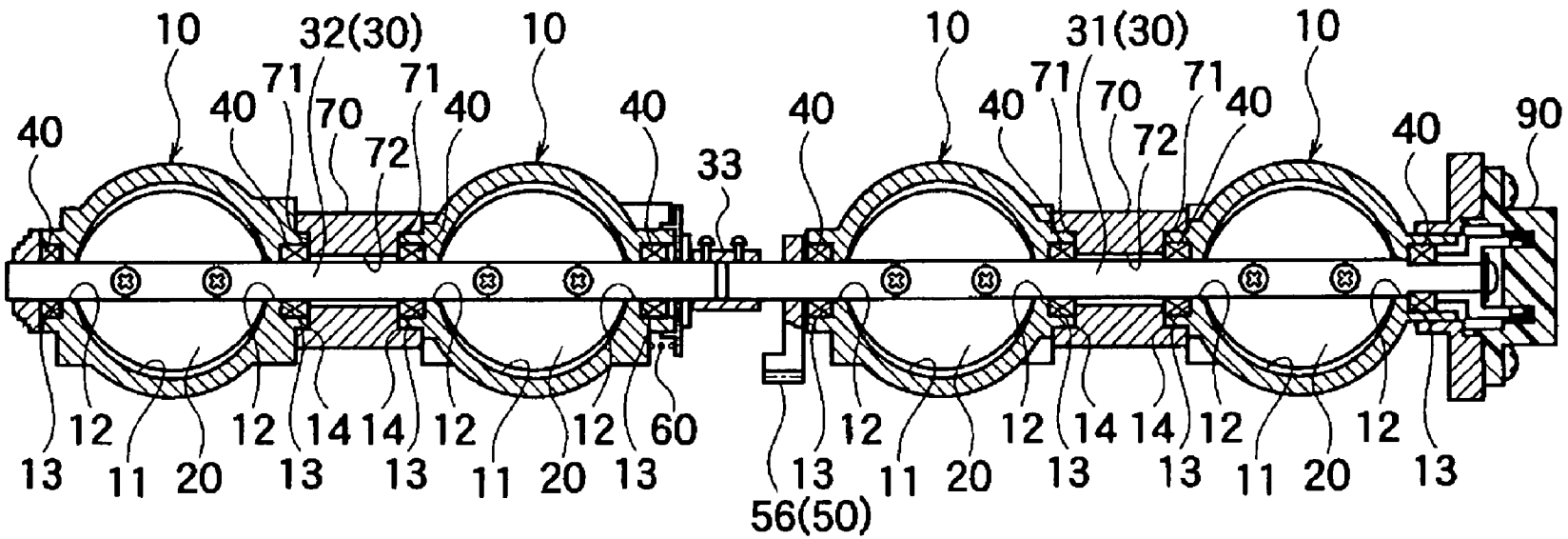
FIG. 3 is a partial sectional view showing a periphery of a throttle shaft and throttle valves of the apparatus shown in FIG. 1.
Figure 4:
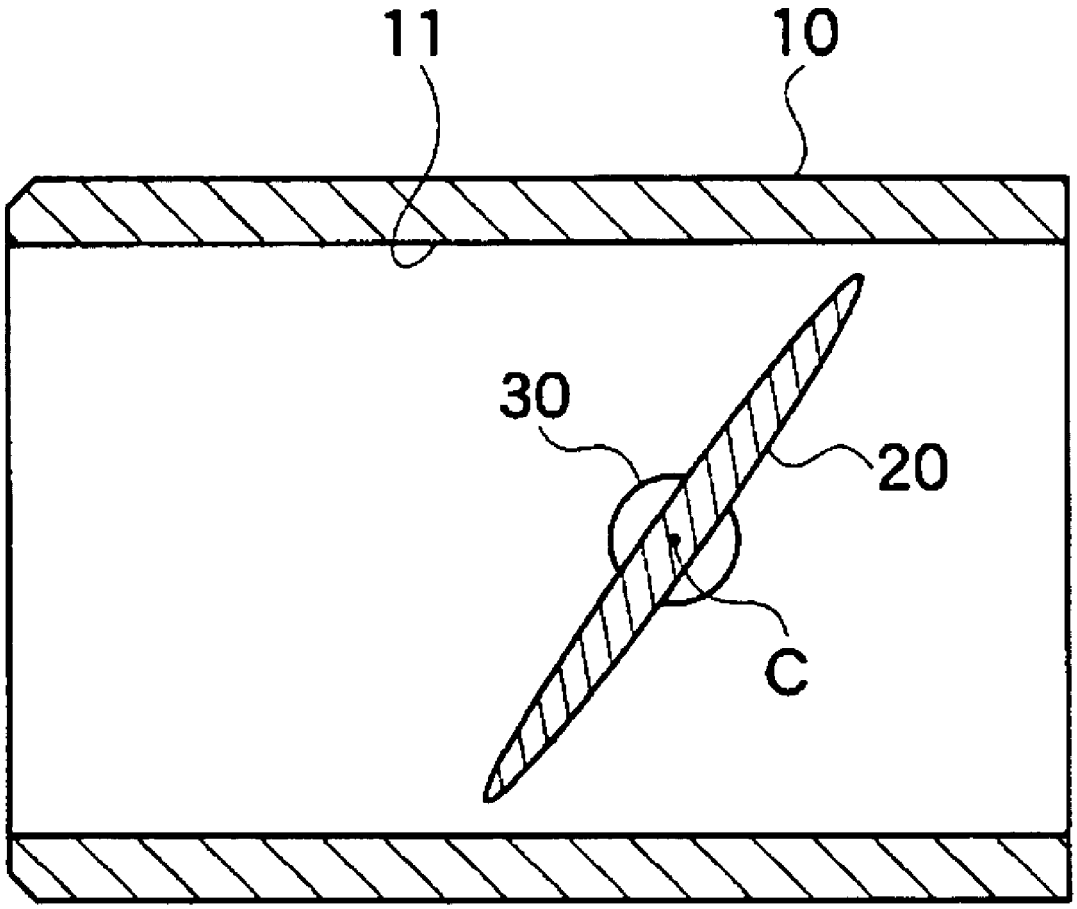
FIG. 4 is a sectional view showing the throttle valve of the apparatus shown in FIG. 1.

FIG. 1 to FIG. 4 show an embodiment of a multi-throttle apparatus according to the present invention, FIG. 1 is a configuration schematic, FIG. 2 is a side view of drive means, FIG. 3 is a sectional view showing a periphery of a throttle shaft, and FIG. 4 is a sectional view showing a throttle valve.

This apparatus is a four-throttle apparatus applied to an inline four-cylinder engine installed on a two-wheeled vehicle, and, as shown in FIG. 1, is provided with four throttle bodies 10 that define intake passages 11, four throttle valves 20 that are disposed in the respective intake passages 11, a throttle shaft 30 that rotatably supports the four throttle valves 20 so as to simultaneously close/open them, bearings 40 that rotatably support the throttle shaft 30, drive means 50 that applies a rotational driving force to the throttle shaft 30, a return spring 60 that returns the throttle valves 20 to a predetermined angular position, spacers 70 that are disposed in the mutual intervals between the throttle bodies 10, connection frames 80 that connect the four throttle bodies 10, an angle detection sensor 90 that detects the rotation angle of the throttle shaft 30, and the like.

The throttle body 10 is molded by means of die forming using an aluminum material or resin material, and, as shown in FIG. 1 to FIG. 3, is formed by the intake passage 11 that has an approximately circular section, through holes 12 that pass the throttle shaft 30, engagement sections 13 in a recessed shape that engage the bearings 40, joint protrusions 14, connection sections 15, 16 that are used to connect an intake duct (intake pipe), and the like.

The through holes 12 are formed slightly larger than the outer diameter of the throttle shaft 30 to achieve a non-contact state, and the throttle shaft 30 is supported only by the bearings 40.

The throttle valves 20 are molded by means of die forming using an aluminum material or resin material, and, as shown in FIG. 4, are formed such that the cross section thereof tapers off to the tip thereof as departed from the rotation center C increases. The throttle valves 20 are fixed to the throttle shaft 30 by means of screws or the like.

Forming the throttle valves 20 in the shape tapering off to the tip in this way reduces the moment of inertia, increases the responsiveness of the opening/closing operations, and contributes to the prevention of the torsion of the throttle shaft 30.

The throttle shaft 30 is constituted by a throttle shaft 31 that passes through the two throttle bodies 10 on the right side, and a throttle shaft 32 that passes through the two throttle bodies 10 on the left side, which are connected via a joint member 33 forming a cylindrical pipe so as to rotate coaxially and integrally, as shown in FIG. 3.

The connection of the two throttle shafts 31, 32 by means of the joint member 33 in this way permits the simultaneous opening/closing of the all throttle valves 20, and facilitates fine adjustment of a phase shift between the left and right and the like during the initialization and the like.

Moreover, the employment of the cylindrical pipe as the joint member 33 which engages the throttle shafts 31, 32 with each other reduces the moment of inertia compared with a lever type, and increases the responsiveness.

As shown in FIG. 3, the bearings 40 are engaged with the engagement sections 13 of the throttle bodies 10, are disposed on both sides of the respective throttle valves 20, and are especially disposed in the mutual intervals between the intake passages 11 (in the areas of the spacers 70).

Even if a resistive force of the intake air generated by the rapid opening/closing operations and the like is applied to deflect middle areas of the throttle shafts 31, 32 via the throttle valves 20, for example, since the middle areas are supported by the bearings 40, a smooth rotation is provided without generating a stick and the like.

Consequently, the torsion of the throttle shafts 31, 32 and the like are prevented, and the synchronization of the throttle valves 20 (opening/closing operations in phase) is secured.

Note that various bearings such as ball bearings, roller bearings, and cylindrical bearings whose contact face itself provides a bearing function, may be employed as the bearing 40. In addition, bearings which provide supports in the thrust direction in addition to the radial direction are employed as at least a part of the multiple bearings 40.

As shown in FIG. 1 to FIG. 3, the drive means 50 is disposed at a location in a mutual interval close to the center (between the second and third throttle valves 20) of the mutual intervals between the throttle valves 20 disposed at multiple (four) locations, namely to the approximate center of the throttle shaft 30 to apply the driving force, and is formed by a holding plate 51 that is fixed to the throttle body 10 or the connection plate 80, a DC motor 52 that is fixed to the holding plate 51, and includes a pinion 52*a*, a gear 53 and a gear 54 that are rotatably supported by the holding plate 51, and mesh with each other, a gear 55 that integrally includes a large gear 55*a* and a small gear 55*b*, a gear 56 that is fixed to the throttle shaft 31 (30), and the like.

Namely, if the DC motor 52 rotates, the driving force thereof is transmitted from the pinion 52*a* to the throttle shaft 30 via the gears 53, 54, 55, 56, and the throttle shaft 30 drives the throttle valves 20 to be opened/closed. On this occasion, since the rotational driving force is applied to the approximate center (middle area) of the throttle shaft 30, the spans from the application point of the driving force to the both ends of the throttle shaft 30 become shorter.

The torsions of the throttle shafts 31, 32 disposed on the both sides of the gear 56 as a border are thus prevented, which secures the mutual synchronization of the throttle valves 20 supported by the throttle shafts 31, 32, and the four throttle valves 20 carry out the open/close operations in phase. Moreover, the arrangement of the drive means 50 at the approximate center reduces the dimension in the width direction of the multi-throttle apparatus, especially restrains protrusions in the widthwise direction upon being installed on a two-wheeled vehicle, and it is thus possible to prevent the apparatus from hitting the ground and the like upon the vehicle falling and the like, and consequently being damaged.

It should be noted that on the holding plate 51 is provided an adjust screw 57 that restricts a stop position of the gear 56, namely a rest position of the throttle valves 20, and an appropriate adjustment of the adjust screw 57 sets the opening of the throttle valves 20 in the rest state to a desired value.

The return spring 60 is a torsion spring disposed close to the gear 56 which applies the driving force as shown in FIG. 1 and FIG. 3, and applies a rotational energizing force to the throttle shaft 30 (32) to return the throttle valves 20 to the predetermined angular position. The application of the energizing force of the return spring 60 close to the driving force prevents the torsion of the throttle shaft 30 (32) as much as possible, and thus secures the synchronization of the throttle valves 20.

Although only one spring is used as the return spring 60 in this case, multiple return springs generating energizing forces different from each other may be disposed along the throttle shaft 30, a return spring which applies the largest energizing force may be disposed close to the location to which the driving force is applied, and the other return springs may be disposed so as to gradually decrease the energizing force toward the both ends of the throttle shaft 30. In this case, the torsion of the throttle shaft 30 is prevented, and the return operation becomes smoother.

The spacer 70 connects the throttle bodies 10 with each other in the extension direction of the throttle shaft 30 as shown in FIG. 1 and FIG. 3. The spacers 70 are formed into a cylindrical shape, and include joint recesses 71 that engage the joint protrusions 14 of the throttle bodies 10, a through passage 72 that passes the throttle shaft 30 without contact, positioning sections (not shown) that mutually position the connected throttle bodies 10, and the like.

The end surfaces of the through passage 72 are formed to push and fix the bearings 40 engaged to the engagement sections 13. An independent component used to fix the bearing 40 is thus not necessary.

If the spacer 70 is used to connect the throttle bodies 10 with each other, the bearings 40 are first installed in the engagement sections 13 of the throttle bodies 10, the throttle bodies 10 are then mutually joined and connected on both sides of the spacer 70, and the connection plate 80 firmly fixes the throttle bodies 10 to each other.

On this occasion, a proper change of the length of the spacer 70 enables application to various engines different in the mutual separated distance between the intake passages 11.

The angle detection sensor 90 is a non-contact angle sensor disposed on one end of the throttle shaft 30 as shown in FIG. 1 and FIG. 3, detects the rotation angle position of the throttle shaft 30 (namely the rotation angle position of the throttle valves 20), and outputs a resulting detection signal to a control unit. The control unit transmits a drive signal to the DC motor 52 based on the detection signal, and controls the opening of the throttle valves 20 according to a control mode.

A description will now be given of the operation of the above-mentioned multi-throttle apparatus.

The DC motor 52 rotates in one direction based on the control signal transmitted from the control unit, and the rotational driving force is applied to the approximate center of the throttle shaft 30 via a gear train 52*a*, 53, 54, 55, 56. The throttle shaft 30 then starts rotating in the one direction against the energizing force of the return spring 60 disposed close thereto, and the throttle valves 20 rotate from the rest position to the position to fully open the intake passages 11.

On this occasion, since the driving force is applied to the approximate center of the throttle shaft 30, the energizing force of the return spring 60 is applied close to the driving force, the throttle shaft 30 is supported by the bearings 40 in mutual intermediate areas between the intake passages 11, and the throttle valves 20 are formed to tapers off to the tip thereof to decrease the moment of inertia, the throttle shaft 30 rotates smoothly, thereby preventing the torsion thereof, and synchronously opens/closes the throttle valves 20 disposed on the both sides of the gear 56 as a border without generating a mutual phase shift of the throttle valves 20.

On the other hand, if the DC motor 52 rotates in the opposite direction based on the control signal from the control unit, the throttle shaft 30 rotates in the opposite direction while the energizing force of the return spring 60 is applied, and the throttle valves 20 rotate from the fully open position to the rest position, which closes the intake passages 11. In the normal operation, the rotation of the DC motor 52 is properly controlled according to the control mode, and the throttle valves 20 are driven to be opened/closed to attain an optimal opening. If the DC motor 52 stops, the throttle shaft 30 is quickly rotated by the energizing force of the return spring 60 to return the throttle valves 20 to the rest position.

If the idle speed control is carried out by means of the throttle valves 20, the DC motor 52 is properly driven based on the drive signal from the control unit, and the throttle shaft 30, namely the opening of the throttle valves 20 is finely adjusted. Since the mutual synchronization of the throttle valves 20 is secured upon carrying out the ISC drive in this way, highly precise control is enabled.

Although the two divided throttle shafts 31, 32 are employed as the throttle shaft 30 in the present embodiment, the configuration of the present invention is not limited to this example, and a single throttle shaft may be employed. Although the spur gears are shown as the gears 53 to 56 constituting the drive means 50, if the configuration includes hypoid gears and the like as well as spur gears, the gears may be readily arranged in a space even narrower in the widthwise direction.

Although the description is given of the four-throttle apparatus in the present embodiment, it is impossible to dispose the drive means 50 at the center of the throttle shaft on a multi-throttle apparatus such as three- or five-throttle apparatus where the odd number of throttle valves are disposed. Thus, the drive means 50 may be disposed such that, of mutual intervals between the throttle valves disposed at multiple locations, the driving force may be applied to a position closer to the center such as a mutual interval between the first and second (or between the second and third) throttle valves for the three-throttle apparatus, and between the second and third (or third and fourth) throttle valves for the five throttle apparatus.

Figure 5:
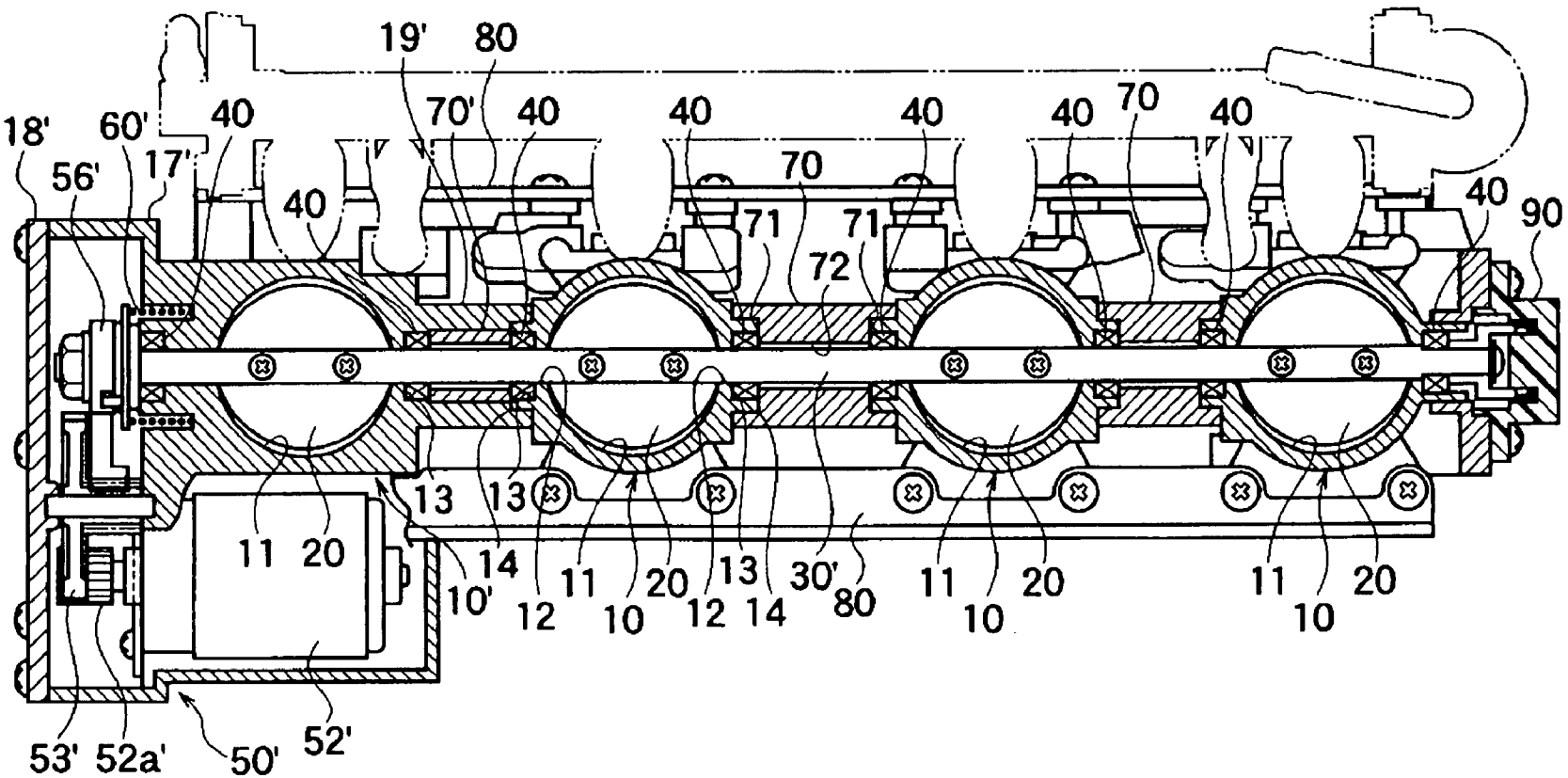
FIG. 5 is a configuration schematic showing another embodiment of the multi-throttle apparatus according to the present invention.
Figure 6:
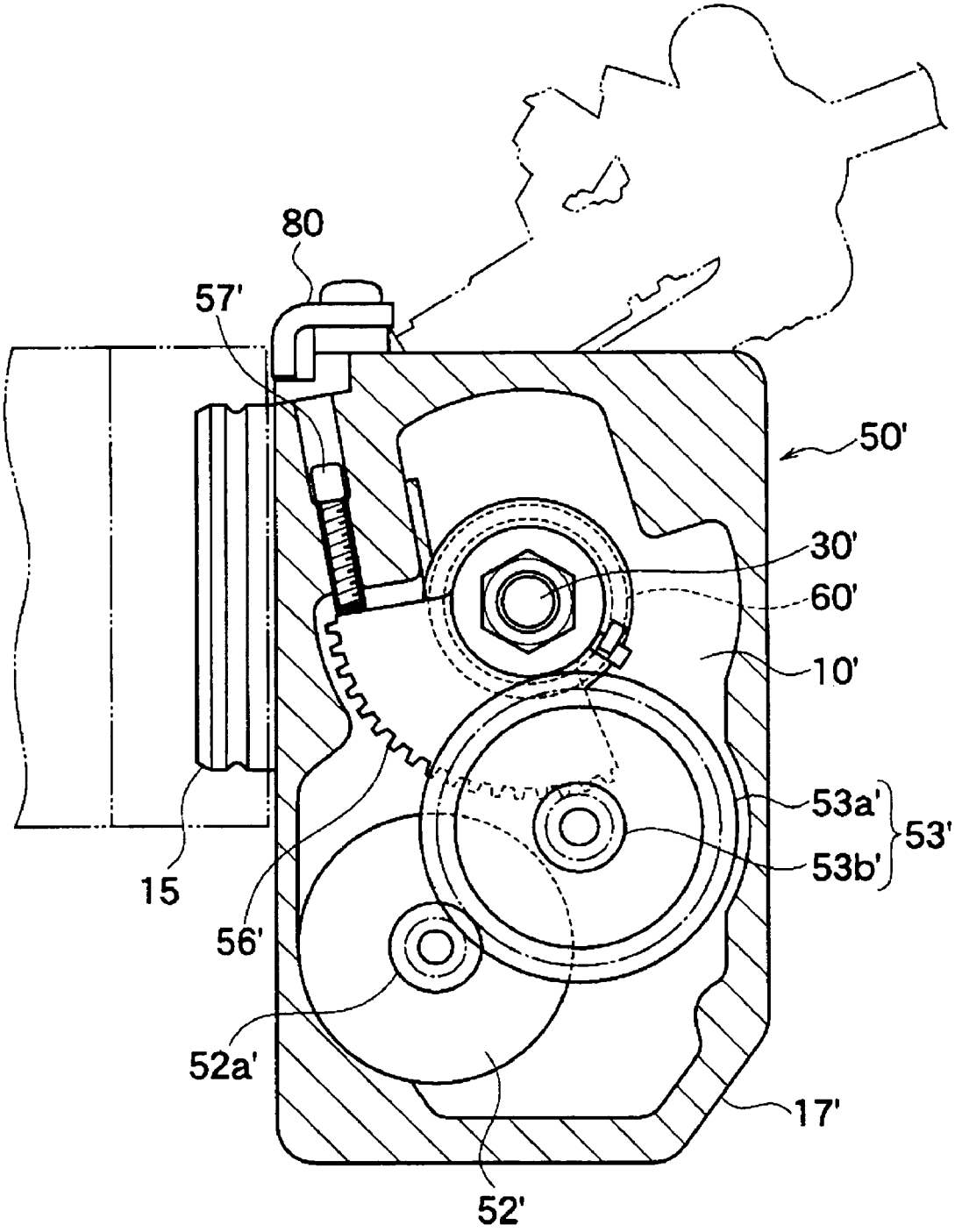
FIG. 6 is a side view showing drive means of the apparatus shown in FIG. 5.

FIG. 5 and FIG. 6 show another embodiment of the multi-throttle apparatus according to the present invention, and is the same as the above-mentioned embodiment except that drive means 50' and a return spring 60' are disposed on one end of a throttle shaft 30'. In the present embodiment, like components are denoted by like numerals as of the above-mentioned embodiment, and will be explained in no more details.

This apparatus, as shown in FIG. 5, is provided with four throttle bodies 10, 10', the four throttle valves 20 that are disposed in the respective intake passages 11, a single throttle shaft 30' that rotatably supports the four throttle valves 20 so as to be simultaneously closed/opened, the bearings 40 that rotatably support the throttle shaft 30', drive means 50' that applies a rotational driving force to the throttle shaft 30', a return spring 60' that returns the throttle valves 20 to a predetermined angular position, spacers 70, 70' that are disposed in the mutual intervals between the throttle bodies 10, the connection frame 80 that connects the four throttle bodies 10, the angle detection sensor 90 that detects the rotation angle of the throttle shaft 30', and the like.

A storage section 17' is formed to dispose the drive means 50' on the one end of the throttle body 10' as shown in FIG. 5, and a holding cover 18' is connected to cover the storage section 17'. A connection section 19' used to connect another throttle body 10 is formed on the other end of the throttle body 10'. The engagement sections 13 are formed on the connection section 19' to attach the bearings 40, and a spacer 70' used to push and fix the bearings 40 is inserted.

The throttle shaft 30', as shown in FIG. 5, is formed by a single shaft that supports the four throttle valves 20 to be driven to simultaneously open/close, and is rotatably supported by the bearings 40 in the mutual intermediate areas between the intake passages 11.

As shown in FIG. 5 and FIG. 6, the drive means 50' is disposed so as to apply the driving force to the one end of the multiple (four) disposed throttle valves 20, namely to the one end (left side) of the throttle shaft 30', and is formed by a DC motor 52' that is fixed to the storage section 17', and includes a pinion 52*a*', a gear 53' that integrally includes a large gear 53*a*' and a small gear 53*b*' rotatably supported by the storage section 17' and the holding cover 18', a gear 56' fixed to the one end of the throttle shaft 30', and the like.

It should be noted that on the storage section 17' is provided an adjust screw 57' that restricts a stop position of the gear 56', namely a rest position of the throttle valves 20, and an appropriate adjustment of the adjust screw 57' sets the opening of the throttle valves 20 in the rest state to a desired value.

The return spring 60' is a torsion spring disposed close to the gear 56' which applies the driving force as shown in FIG. 5 and FIG. 6, and applies a rotational energizing force to the throttle shaft 30' to return the throttle valves 20 to the predetermined angular position. The application of the energizing force of the return spring 60' to the location close to the driving force prevents the torsion of the throttle shaft 30', and thus secures the mutual synchronization of the throttle valves 20.

In the above-mentioned configuration, if the DC motor 52' rotates, the rotational driving force thereof is transmitted from the pinion 52*a*' to the throttle shaft 30' via the gears 53', 56'. Consequently, the throttle shaft 30' rotates the throttle valves 20 toward the open side against the energizing force of the return spring 60', and if the DC motor 52' stops, the throttle valves 20 is quickly rotated toward the close side by the energizing force of the return spring 60'.

Since the energizing force of the return spring 60' is applied close to the driving force, the torsion of the throttle shaft 30' is prevented, and the mutual synchronization of the throttle valves 20 is thus secured. Since the drive means 50' can be disposed on a section on the one side, this configuration is proper for a case where the mutual separated distance between the intake passages 11 is small, and the drive means 50' thus cannot be disposed close to the center.

Although only one spring is used as the return spring 60' in this case, multiple return springs generating energizing forces different from each other may be disposed along the throttle shaft 30', a return spring which applies the largest energizing force may be disposed close to the location to which the driving force is applied, and the other return springs are disposed so as to gradually decrease the energizing forces toward the other end of the throttle shaft 30'. In this case, the torsion of the throttle shaft 30' is prevented, and the return operation becomes smoother.

Also in this embodiment, since the throttle shaft 30' is supported by the bearings 40 in the mutual intermediate areas between the intake passages 11, and the throttle valves 20 are formed to taper off to the tip thereof to decrease the moment of inertia, the throttle shaft 30' rotates without generating the torsion and with proper responsiveness, and drives the throttle valves 20 to be opened/closed while the mutual synchronization is secured.

Figure 7:
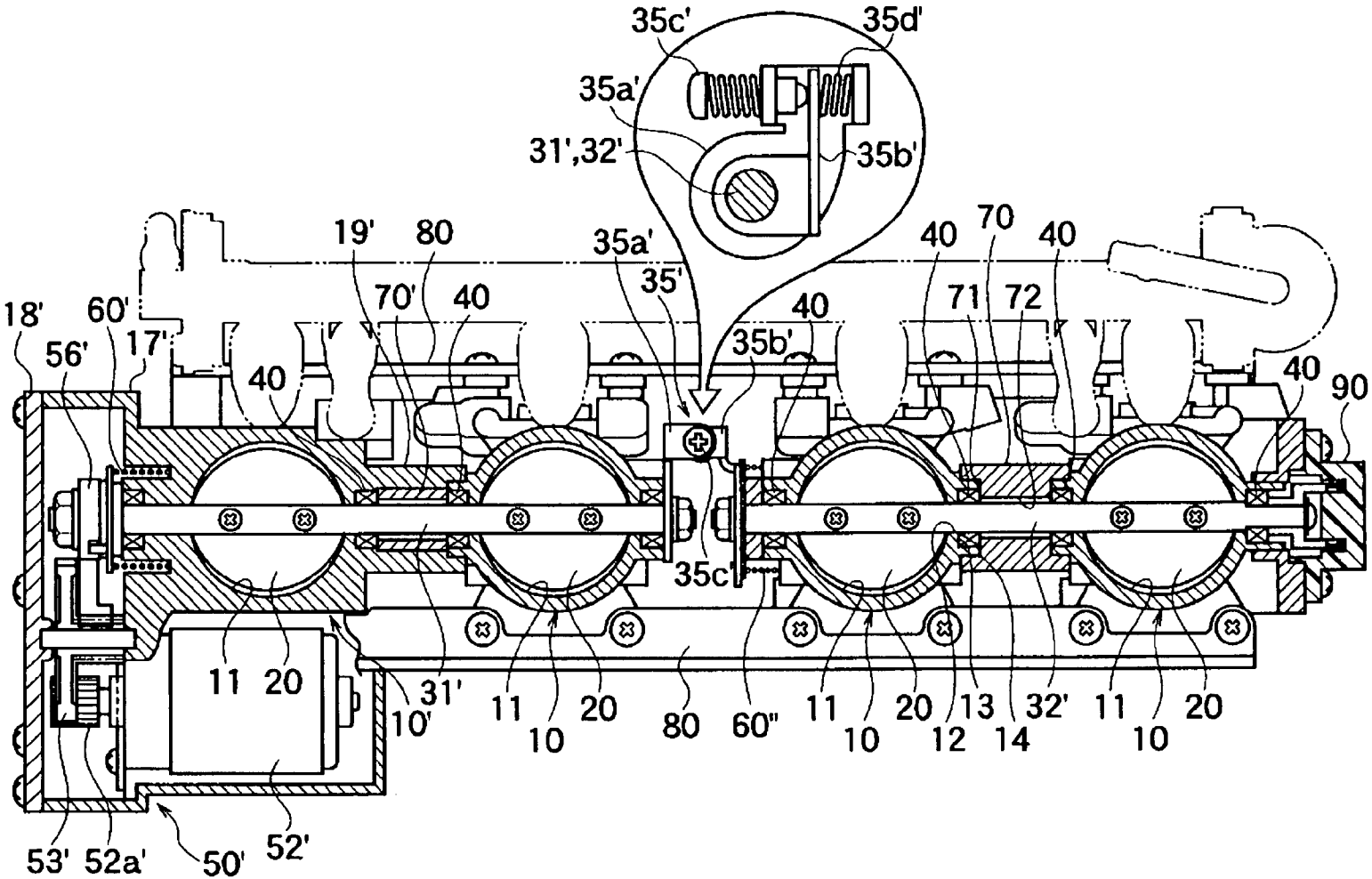
FIG. 7 is a configuration schematic showing still another embodiment of the multi-throttle apparatus according to the present invention.

FIG. 7 shows a still another embodiment of the multi-throttle apparatus according to the present invention, two divided throttle shafts 31, 32 are used in place of the throttle shaft 30' according to the embodiment shown in FIG. 5 and FIG. 6, both of them are connected by a synchronization lever 35', and multiple return springs 60', 60" are employed. Like components are denoted by like numerals as of the above-mentioned embodiments and will be explained in no more details.

This apparatus includes throttle shafts 31', 32' separated at an approximate center to support the each two throttle valves 20 to be simultaneously opened/closed as shown in FIG. 7, and is formed such that both of them are connected by the synchronization lever 35' to rotate coaxially in an interlocking manner.

The synchronization lever 35' is formed by a lever 35*a*' that is connected to the throttle shaft 31', a lever 35*b*' that is connected to the throttle shaft 32', a synchronization screw 35*c*' that operates both levers 35*a*', 35*b*' in an interlocking manner, and a spring 35*d*' as shown in FIG. 7.

Namely, the relationship between the synchronization screw 35*c*' and the spring 35*d*' is such that if the opening operation is made in an interlocking manner by means of the spring 35*d*', the closing operation is rigidly connected by means of the synchronization screw 35*c*', for example. The synchronization lever 35' is formed such that the arm is shorter than a conventional one to reduce the moment of inertia.

As a return spring, multiple (two in this case) springs 60', 60" generating energizing forces different from each other are employed. The return spring 60' generates a larger energizing force than that of the other return spring 60", and is disposed close to the drive means 50. On the other hand, the other return spring 60" generates a smaller energizing force, and is disposed close to the lever 35*b*' fixed to the throttle shaft 32', namely in an approximately middle area of the whole throttle shafts 31', 32'.

Of the multiple return springs 60', 60" that are disposed along the throttle shafts 31', 32', and apply the energizing forces different from each other, since the return spring 60' which applies the largest energizing force is disposed close to the gear 56' which applies the driving force, and the other return spring 60" which applies smaller energizing force is disposed in the separated area, the torsions of the throttle shafts 31', 32' are prevented, and the return operation is carried out smoothly.

Also, in this embodiment, since the throttle shafts 31', 32' are supported by the bearings 40 in the mutual intermediate areas between the intake passages 11, and the throttle valves 20 are formed to taper off to the tip thereof to decrease the moment of inertia, the throttle shafts 31', 32' rotate without the torsion and with proper responsiveness, and drive the throttle valves 20 to be opened/closed while the mutual synchronization is secured.

Although the description is given of the four-throttle apparatus as the multi-throttle apparatus in the above-mentioned embodiment, the configuration of the present invention is not limited to this example, and may be employed in multi-throttle apparatuses such as three-, or five or more-throttle apparatus. Although the description is given of the case including the two return springs 60', 60" as the multiple return springs different in the energizing force, the configuration is not limited to this example, and a configuration including three or more return springs may be employed.

Although the spacers 70 are used to connect the multiple throttle bodies 10, 10' in the above-mentioned embodiments, the throttle bodies 10, 10' may be directly joined for the connection without using the spacers 70. Although the description is given of the multiple throttle bodies 10, 10' formed independently, an integrally formed single throttle body may be employed as long as the bearings 40 can be installed.

Further, although the description is given of the high-performance engines installed on the two-wheeled vehicles as the engines to which the multi-throttle apparatus according to the present invention is applied in the above-mentioned embodiments, the engines are not limited to this type, and the present invention may be applied to engines installed on other vehicles such as automobiles.

INDUSTRIAL APPLICABILITY

As described above, with the multi-throttle apparatus according to the present invention, upon driving the throttle shaft, which uses the motor to simultaneously open/close multiple throttle valves disposed in the multiple intake passages formed in the throttle body, since the driving force of the motor is applied to the approximate center or the one end of the throttle shaft, the energizing force of the return spring is applied close to the driving force, and the bearings supporting the throttle shaft are provided in the mutual intervals between the multiple intake passages, the torsion of the throttle shaft is prevented, and the respective throttle valves do not generate a phase shift, are synchronously opened/closed, and follow quick changes with proper responsiveness to operate smoothly.

The invention claimed is:

1. A multi-throttle apparatus, comprising:

a throttle body that defines a plurality of intake passages corresponding to respective engine cylinders;

a plurality of throttle valves that are disposed respectively in said plurality of intake passages;

a throttle shaft that supports said plurality of throttle valves to be simultaneously opened/closed;

drive means that includes a motor for rotatably driving said throttle shaft; and a return spring that returns said throttle valves to a predetermined angular position, wherein said drive means is disposed to apply a driving force to said throttle shaft at a location in a mutual interval close to the center, said mutual interval being one of mutual intervals between said throttle valves disposed at a plurality of locations, said return spring is disposed close to a location to which the driving force of said drive means is applied, said throttle body includes bearings that support said throttle shaft in said plurality of mutual intervals between said intake passages, and said throttle shaft comprises two throttle shafts separated by the area as a border to which the driving force of said drive means is applied, said two throttle shafts being connected so as to rotate coaxially and integrally.

2. A multi-throttle apparatus, comprising:

a throttle body that defines a plurality of intake passages corresponding to respective engine cylinders;

a plurality of throttle valves that are disposed respectively in said plurality of intake passages;

a throttle shaft that supports said plurality of throttle valves to be simultaneously opened/closed;

drive means that includes a motor for rotatably driving said throttle shaft; and a return spring that returns said throttle valves to a predetermined angular position, wherein said drive means is disposed to apply a driving force to said throttle shaft at a location in a mutual interval close to the center, said mutual interval being one of mutual intervals between said throttle valves disposed at a plurality of locations, said return spring is disposed close to a location to which the driving force of said drive means is applied, said throttle body includes bearings that support said throttle shaft in said plurality of mutual intervals between said intake passages, and said throttle body is comprised of a plurality of throttle bodies that respectively define said plurality of intake passages, and are connected to each other in the direction in which said throttle shaft extends, and said plurality of throttle bodies comprise an engagement section that engages said bearing.

3. A multi-throttle apparatus, comprising:

a throttle body that defines a plurality of intake passages corresponding to respective engine cylinders;

a plurality of throttle valves that are disposed respectively in said plurality of intake passages;

a throttle shaft that supports said plurality of throttle valves to be simultaneously opened/closed;

drive means that includes a motor for rotatably driving said throttle shaft; and a return spring that returns said throttle valves to a predetermined angular position, wherein said drive means is disposed to apply a driving force to said throttle shaft at a location on one end of said throttle valves disposed at a plurality of locations, said return spring is disposed close to a location to which the driving force of said drive means is applied, said throttle body includes a bearing that supports said throttle shaft in said location between said intake passages, and said throttle body is comprised of a plurality of throttle bodies that respectively define said plurality of intake passages, and are connected to each other in the direction in which said throttle shaft extends, said plurality of throttle bodies comprising an engagement section that engages said bearing.

4. The multi-throttle apparatus according to claim 1, 2 or 3, wherein said return spring includes a plurality of return springs that are disposed along said throttle shaft, and apply energizing forces different from each other, and a return spring of said plurality of return springs that applies the largest energizing force is disposed close to the location to which the driving force of said drive means is applied.

5. The multi-throttle apparatus according to claim 2 or 3, wherein said plurality of throttle bodies are connected with each other via a spacer that adjusts the mutual separated distance.

6. The multi-throttle apparatus according to claim 5, wherein said spacer is formed so as to fix said bearing to said throttle body.

7. The multi-throttle apparatus according to claim 1, 2 or 3, wherein said plurality of throttle valves are formed such that the cross section thereof tapers off to the tip thereof as departed from the rotation center.

8. The multi-throttle apparatus according to claim 1, wherein said return spring includes a plurality of return springs that are disposed along said throttle shaft, and apply energizing forces different from each other, and a return spring of said plurality of return springs that applies the largest energizing force is disposed close to the location to which the driving force of said drive means is applied.

9. The multi-throttle apparatus according to claim 1, wherein said throttle body is comprised of a plurality of throttle bodies that respectively define said plurality of intake passages, and are connected to each other in the direction in which said throttle shaft extends, and said plurality of throttle bodies comprise an engagement section that engages said bearing.

10. The multi-throttle apparatus according to claim 4, wherein said throttle body is comprised of a plurality of throttle bodies that respectively define said plurality of intake passages, and are connected to each other in the direction in which said throttle shaft extends, and said plurality of throttle bodies comprise an engagement section that engages said bearing.

11. The multi-throttle apparatus according to claim 9, wherein said plurality of throttle bodies are connected with each other via a spacer that adjusts the mutual separated distance.

12. The multi-throttle apparatus according to claim 10, wherein said plurality of throttle bodies are connected with each other via a spacer that adjusts the mutual separated distance.

13. The multi-throttle apparatus according to claim 11, wherein said spacer is formed so as to fix said bearing to said throttle body.

14. The multi-throttle apparatus according to claim 12, wherein said spacer is formed so as to fix said bearing to said throttle body.

* * * * *